US005135842A

United States Patent [19]

Kitchin et al.

[11] Patent Number: 5,135,842

[45] Date of Patent: Aug. 4, 1992

[54] THERMAL DYE BLEACH CONSTRUCTION

[75] Inventors: Jonathan P. Kitchin, Hertford; Mark P. Kirk, Bishop's Stortford; Dian E. Stevenson, Harlow, all of England; Randall H. Helland, Maplewood, Minn.

[73] Assignee: Minnesota Mining and Manufacturing Company, St. Paul, Minn.

[21] Appl. No.: 529,333

[22] Filed: May 29, 1990

[30] Foreign Application Priority Data

Jun. 12, 1989 [GB] United Kingdom ..... 8913444

[51] Int. Cl.[5] ..... G03C 1/815

[52] U.S. Cl. ..... 430/510; 430/339; 430/517; 430/522; 430/944; 430/964; 252/583; 252/587

[58] Field of Search ..... 430/510, 944, 517, 964, 430/522, 339; 252/583, 587

[56] References Cited

U.S. PATENT DOCUMENTS 3,220,846 11/1965 Tinker et al. ..... 430/350
3,864,552 8/1972 Wiese et al. ..... 117/36.8
4,060,420 11/1977 Merkel et al. ..... 430/177

OTHER PUBLICATIONS

W. S. Tuemmler and B. S. Wildi, *J. Amer. Chem. Soc.*, 80, p. 3772 (1958).

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

A thermal-dye-bleach construction comprising a thermal nucleophile-generating agent in association with a polymethine dye having a nucleus of general formula (I):

(I)

in which:

n is 0, 1, 2 or 3;

$R^1$ and $R^4$ are independently selected from the group consisting of hydrogen atoms, optionally substituted alkyl groups of up to 30 carbon atoms, optionally substituted alkenyl groups of up to 30 carbon atoms and optionally substituted aryl groups of up to 14 carbon atoms; and $R^1$ and $R^2$ together and/or $R^3$ and $R^4$ together may represent the necessary atoms to complete a 5 or 6-membered optionally substituted heterocyclic ring; or one or more of $R^1$ to $R^4$ may represent the necessary atoms to complete an optionally substituted 5 or 6-membered heterocyclic ring fused to the phenyl ring on which the $NR^1R^2$ or $NR^3R^4$ group is attached;

$R^5$ and $R^6$ are independently selected from the group consisting of hydrogen atoms, tertiary amino groups, optionally substituted alkyl groups of up to 10 carbon atoms, optionally substituted aryl groups of up to 10 carbon atoms, optionally substituted heterocyclic rings comprising up to 6 ring atoms, optionally substituted carbocyclic rings comprising up to 6 carbon atoms and optionally substituted fused ring systems comprising up to 14 ring atoms, and, $X^{\ominus}$ is an anion.

14 Claims, 1 Drawing Sheet

THERMAL DYE BLEACH CONSTRUCTION

FIELD OF THE INVENTION

This invention relates to a thermal-dye-bleach system and in particular to a thermal-dye-bleach system comprising a polymethine dye and a thermal nucleophile generating agent, and the use of the system in photographic materials.

BACKGROUND TO THE INVENTION

The increasing availability and use of semiconductor light sources and particularly laser diodes which emit in the near infrared region of the electromagnetic spectrum has led to a need for high quality photographic materials which are sensitive in this region, especially from 650 nm to 850 nm.

In order to improve the image sharpness of photographic materials it is customary to incorporate a dye in one or more layers of the material, the purpose of which is to absorb light that has been scattered within the coating and would otherwise lead to reduced image sharpness. Dyes used for this purpose are known as antihalation dyes if incorporated in a separate backing layer or underlayer and as acutance dyes if incorporated into the light sensitive layer itself.

It is usually essential that antihalation or acutance dyes should completely decolourise under the processing conditions of the photographic material concerned. In the case of photothermographic materials which are processed by simply heating for a short period usually between 100° C. and 200° C. any antihalation or acutance dyes used must decolourise thermally.

Various thermal-dye-bleach systems are known in the prior art including single compounds which spontaneously decompose and decolourise at elevated temperature and combinations of dye and thermal dye bleaching agent which together form a thermal-dye-bleach system.

U.S. Pat. Nos. 3,609,360, 3,619,194, 3,627,527, 3,684,552, 3,852,093, 4,033,948, 4,088,497, 4,196,002, 4,197,131, 4,201,590 and 4,283,487 disclose various thermal-dye-bleach systems which absorb principally in the visible region of the electromagnetic spectrum and as such they are not readily adaptable for use as near infrared absorbing constructions. No indication or examples are given of near infrared absorbing thermal-dye-bleach systems.

A variety of thermal base-generating agents are known and have been used in photothermographic materials. However, in all cases in which thermal base-releasing agents have been incorporated into photothermographic constructions in the prior art the purpose has been to increase the alkalinity of the medium during thermal processing and to promote the development reaction. Thermal base-releasing agents have been used thus in photothermographic materials of both the diazo type and silver based materials.

Our co-pending European Patent Application No. 89312472.7, filed Nov. 30, 1989, discloses the use of certain polymethine dyes for infra-red antihalation in both wet-processed and dry-processed photographic materials. The dyes bleach completely during wet-processing, but remain unbleached after dry-processing. This is acceptable for some purposes because the dyes have a relatively small component of their absorption in the visible region, which can be masked for example, by using a blue-tinted polyester base. For most applications, however, it is preferable that the dyes bleach completely during dry-processing, leaving no residual stain.

SUMMARY OF THE INVENTION

It has now been found that certain polymethine dyes will completely bleach upon heating in the presence of thermal nucleophile-generating agents.

According to the present invention there is provided a thermal-dye-bleach construction comprising a thermal nucleophile-generating agent in association with a polymethine dye having a nucleus of general formula (I):

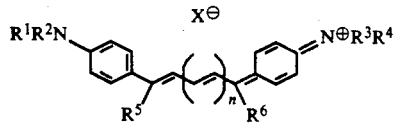

(I)

in which:

n is 0, 1, 2 or 3;

$R^1$ to $R^4$ are independently selected from the group consisting of hydrogen atoms, optionally substituted alkyl groups of up to 30 carbon atoms, optionally substituted alkenyl groups of up to 30 carbon atoms and optionally substituted aryl groups of up to 14 carbon atoms; or $R^1$ and $R^2$ together and/or $R^3$ and $R^4$ together may represent the necessary atoms to complete a 5 or 6-membered optionally substituted heterocyclic ring; or one or more of $R^1$ to $R^4$ may represent the necessary atoms to complete an optionally substituted 5 or 6-membered heterocyclic ring fused to the phenyl ring on which the $NR^1R^2$ or $NR^3R^4$ group is attached;

$R^5$ and $R^6$ are independently selected from the group consisting of hydrogen atoms, tertiary amino groups, optionally substituted alkyl groups of up to 10 carbon atoms, optionally substituted aryl groups of up to 10 carbon atoms, optionally substituted heterocyclic rings comprising up to 6 ring atoms, optionally substituted carbocyclic rings comprising up to 6 carbon atoms and optionally substituted fused ring systems comprising up to 14 ring atoms, and, $X^{\ominus}$ is an anion.

DESCRIPTION OF PREFERRED EMBODIMENTS

Figure 1:
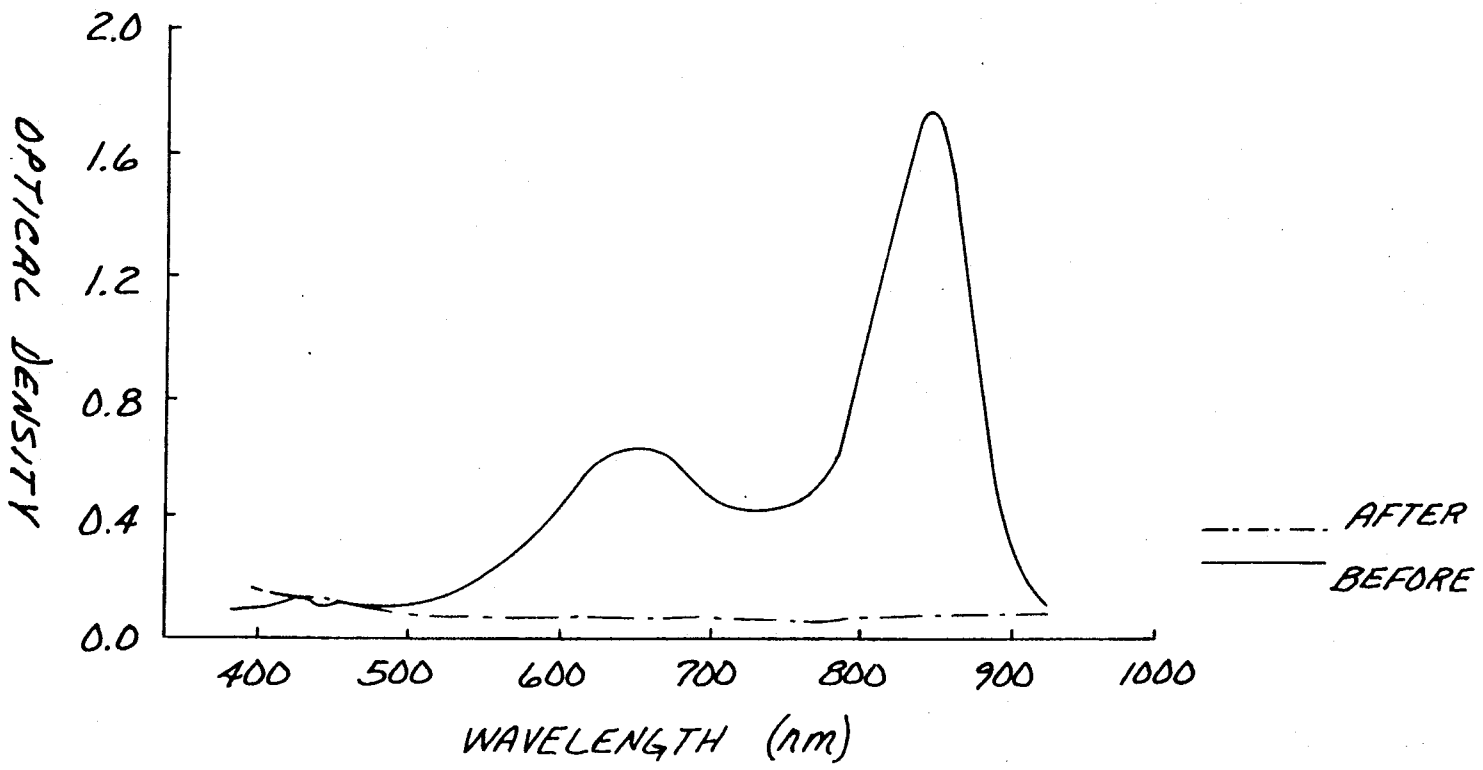

The polymethine dyes of formula (I) are known and are disclosed, for example, in W. S. Tuemmler and B. S. Wildi, *J. Amer. Chem. Soc.*, 80, p. 3772 (1958), H. Lorenz and R. Wizinger, Helv. Chem. Acta., 28, p.600 (1945), U.S. Pat. Nos. 2,813,802, 2,992,938, 3,099,630, 3,275,442, 3,436,353 and 4,547,444 and Japanese Patent No. 56-109358. The dyes have found utility in infrared screening compositions, as hotochromic materials, as sensitisers for photoconductors and as infrared absorbers for optical data storage media. Dyes in accordance with formula (I) have been shown to bleach in conventional photographic processing solutions, as disclosed in our co-pending European Patent Application No. 89312472.7, but have not hitherto been known to bleach by a thermal dry process.

The combination of the polymethine dye, which may be a near infrared absorbing dye, with a thermal nucleophile-generating agent, e.g., a thermal amine-generating agent, finds particular utility as antihalation or acutance constructions in photothermographic materials, e.g., dry silver materials, since the dyes will readily bleach during the thermal processing of the materials.

A wide variety of thermal nucleophile-generating agents may be used for the purposes of this invention but a preferred embodiment utilizes a thermal amine-generating agent, for example an amine salt of an organic acid which is decarboxylated upon heating to yield the free amine. Preferably the free amine should be a primary or secondary amine.

Compounds of this type are disclosed, for example, in U.S. Pat. Nos. 3,220,846, 4,060,420 and 4,731,321. Japanese Patent Application No. 1-150575 discloses thermally-releasable bis-amines in the form of their bis(aryl sulphonylacetic acid)salts. Other amine-generating compounds include 2-carboxycarboxamide derivatives disclosed in U.S. Pat. No. 4,088,469, hydroxime carbamates disclosed in U.S. Pat. No. 4,511,650 and aldoxime carbamates disclosed in U.S. Pat. No. 4,499,180.

In the dyes of general formula (I), $R^1$ to $R^4$ are generally selected from hydrogen atoms, optionally substituted alkyl and alkenyl groups of up to 30 carbon atoms, usually up to 10 carbon atoms and more often up to 5 carbon atoms and optionally substituted aryl groups of up to 14 carbon atoms, but more usually up to 10 carbon atoms.

When the groups $R^1$ to $R^6$ are substituted the substituents may be selected from a wide range of substituents providing they do not cause autobleaching of the dye, for example, substituents having free amino groups promote autobleaching unless the amino group is attached directly to the delocalised electron system. Generally the substituents are selected from; halogen atoms, nitro groups, nitrile groups, hydroxyl groups, ether groups of up to 5 carbon atoms, thioether groups of up to 5 carbon atoms, ketone groups of up to 5 carbon atoms, aldehyde groups of up to 5 carbon atoms, ester groups of up to 5 carbon atoms, amide groups of up to 5 carbon atoms, alkylthio groups of up to 5 carbon atoms, alkoxy groups of up to 5 carbon atoms, alkyl groups of up to 5 carbon atoms, alkenyl groups of up to 5 carbon atoms, aryl groups of up to 10 carbon atoms and heterocyclic ring nuclei comprising up to 10 atoms selected from C, N, O, S and Se, and combinations of these substituents.

Generally $R^1=R^2$ and $R^3=R^4$. Preferred examples of $R^1$ to $R^4$ groups are selected from methyl, ethyl and methoxyethyl groups.

In addition $R^1$ and $R^2$ together and/or $R^3$ and $R^4$ together may represent the non-metallic atoms necessary to complete a nucleus of a 5 or 6-membered heterocyclic ring. When completing such a ring the atoms are generally selected from non-metallic atoms comprising C, N, O, S and Se and each ring may be optionally substituted with one or more substituents as described above. The heterocyclic ring nuclei so completed may be any of those known in polymethine dye art but preferred examples include morpholine and pyrrolidine.

$R^5$ and $R^6$ are generally selected from hydrogen atoms, tertiary amino groups, optionally substituted alkyl groups of up to 10 carbon atoms but more usually up to 5 carbon atoms and aryl groups of up to 10 carbon atoms; each of which group may be substituted by one or more substituents as described above and additionally when $R^5$ and/or $R^6$ represent an aryl group then additional substituents may include $NR^1R^2$ and $NR^3R^4$ (in which $R^1$ to $R^4$ are as defined above). Preferred examples of $R^5$ and $R^6$ are selected from hydrogen atoms, 4-dimethylaminophenyl, 4-diethylaminophenyl, 4-bis(methoxy ethyl) aminophenyl, 4-N-pyrrolidinophenyl, 4-N-morpholinophenyl or bi-phenyl groups.

$R^5$ and R6 may also represent a nucleus of a 5 or R5 6-membered heterocyclic ring, in which ring atoms are selected from C, N, O, S and Se, a 5 or 6-membered carbocyclic ring or a fused ring system comprising up to 14 ring atoms selected from C, N, O, S and Se, wherein each ring may possess one or more substituents as described above. Preferred examples include morpholine and thiophene nuclei.

Suitable anions for $X^{\ominus}$include organic anions such as those containing a sulphonyl group as the ionic determinant, for example, trifluoromethanesulphonate and 4-toluene sulphonate.

The length of the polymethine chain is determined by n which has integral values in the range of $0 \leqq n \leqq 3$ completing tri-, penta-, hepta- and nonameth lengths. The polymethine chain may be unsubstituted or contain substituents, for example alkyl groups, generally of up to 5 carbon atoms, substituted alkyl groups, of up to 5 carbon atoms, hydroxyl groups or halogen atoms may be present. The polymethine chain may contain a bridging moiety, for example, those non-metallic atoms necessary to complete a heterocyclic ring or a fused ring system or a carbocyclic ring, each of which may possess alkyl substituents of 1 to 5 carbon atoms. Examples of bridgin moieties include cyclohexene and cyclopentene nuclei.

In addition to the ring substituents shown in general formula (I) of the central dye nucleus, the dyes may possess ring substituents in other positions which are generally selected from the range of substituents suitable for the groups $R^1$ to $R^6$.

A preferred group of dyes have a nucleus of general formula (II):

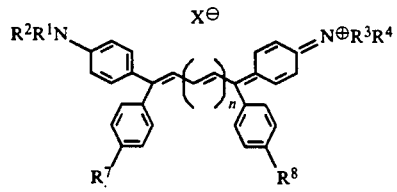

(II)

in which $R^1$ to $R^4$, $X^{\ominus}$and n are as defined above, and, $R^7$ and $R^8$ are independently selected from $NR^1R^2$ (in which $R^1$ and $R^2$ are as defined previously), hydrogen atoms, alkyl groups of up to 10 carbon atoms, alkenyl groups of up to 10 carbon atoms and aryl groups of up to 10 carbon atoms, each of which groups may possess one or more substituents as defined for $R^1$ to $R^6$.

The following Table 1 reports a series of bleachable dyes of general formula (II) which have been prepared:

TABLE 1

| DYE | n | $X^{\ominus}$ | $NR^1R^2$ | $NR^3R^4$ | $R^7$ | $R^8$ |
|---|---|---|---|---|---|---|
| D1 | 1 | $CF_3SO_3^{\ominus}$ | $N(CH_3)_2$ | $N(CH_3)_2$ | $N(CH_3)_2$ | $N(CH_3)_2$ |
| D2 | 1 | $CF_3SO_3^{\ominus}$ | $N(CH_3)_2$ | $N(CH_3)_2$ | H | H |

TABLE 1-continued

| DYE | n | $X^{\ominus}$ | $NR^1R^2$ | $NR^3R^4$ | $R^7$ | $R^8$ |
|---|---|---|---|---|---|---|
| D3 | 1 | 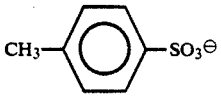 | $N(CH_3)_2$ | $N(CH_3)_2$ | $N(CH_3)_2$ | $N(CH_3)_2$ |
| D4 | 1 | $CF_3SO_3^{\ominus}$ | $N(CH_3)_2$ | $N(CH_3)_2$ | 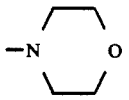 | 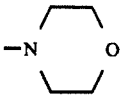 |
| D5 | 1 | $CF_3SO_3^{\ominus}$ | $N(C_2H_5)_2$ | $N(C_2H_5)_2$ | $N(C_2H_5)_2$ | $N(C_2H_5)_2$ |
| D6 | 1 | $CF_3SO_3^{\ominus}$ | 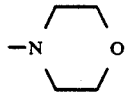 | 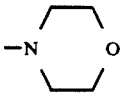 | 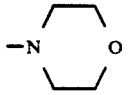 | 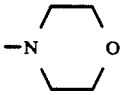 |
| D7 | 1 | $CF_3SO_3^{\ominus}$ | $N(CH_3)_2$ | $N(CH_3)_2$ | 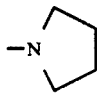 | 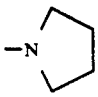 |
| D8 | 1 | $CF_3SO_3^{\ominus}$ | $-N(C_2H_4OCH_3)_2$ | $-N(C_2H_4OCH_3)_2$ | 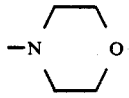 | 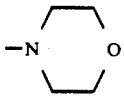 |
| D9 | 1 | $CF_3SO_3^{\ominus}$ | $N(C_2H_5)_2$ | $N(C_2H_5)_2$ | 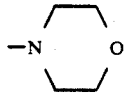 | 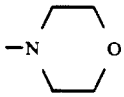 |
| D10 | 1 | $CF_3SO_3^{\ominus}$ | $N(CH_3)_2$ | $N(CH_3)_2$ | $N(CH_3)_2$ | 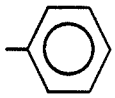 |

Other dyes which have been prepared are of general formula (I) and reported in the following Table 2.

TABLE 2

| DYE | n | $X^{\ominus}$ | $NR^1R^2$ | $NR^3R^4$ | $R^5$ | $R^6$ |
|---|---|---|---|---|---|---|
| D11 | 1 | $CF_3SO_3^{\ominus}$ | $N(CH_3)_2$ | $N(CH_3)_2$ | 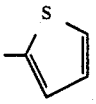 | 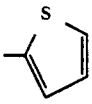 |
| D12 | 1 | $CF_3SO_3^{\ominus}$ | $N(CH_3)_2$ | $-N(C_2H_4OCH_3)_2$ | $N(CH_3)_2$ | H |
| D13 | 0 | $CF_3SO_3^{\ominus}$ | $N(CH_3)_2$ | 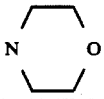 | $N(CH_3)_2$ | H |

For the purpose of the invention the dye of structure (I) and the thermal amine-generating agent are usually coated together with an organic binder as a thin layer on a base support.

The heat bleachable construction thus formed may be used as an antihalation coating for photothermography or it may be used directly as a thermographic material.

For antihalation purposes such a dye/amine generator composite may be present in a layer separate from the photothermographic material either above or below the thermographic material. In the case of transparent supports the antihalation construction may be positioned on the surface of the support opposite the photothermographic material.

The molar ratio of dye to amine-generator is not particularly critical but usually an excess of amine-generator is used.

A wide variety of polymers are suitable for use as the binder in the heat bleachable construction. The activity of the thermal-dye-bleach layer may be adjusted by suitable choice of polymeric binder. In general polymeric binders of lower glass transition temperatures produce more active thermal-dye-bleach constructions.

Thermal-dye-bleach layers with a wide variety of decolorization temperatures may be prepared by suitable choice of polymeric binder.

The dyes are generally included in antihalation layers to provide a transmissive optical density of greater than 0.1 at λ max of the dye. Generally the coating weight of dye which will provide the desired effect is from 0.1 to 1.0 mg/dm$^2$.

The type of photothermographic medium used in the invention is not critical. Examples of suitable photothermographic media include dry silver systems and diazo systems.

The invention will now be illustrated by the following Examples:

EXAMPLE 1

Use of Dl as a potential thermographic medium.

Guanidine trichloroacetate (160mg) and Dye Dl (10 mg) were dissolved in butan-2-one (4ml) and B76 polyvinylbutyral (4ml 15% in butan-2-one) was added. This solution was coated at 100 micron wet thickness on a polyester base. The coating was dried at 80° C. for 3 minutes. The visible and infrared absorption of the coating is shown in the accompanying drawing which represents a plot of optical density against wavelength for the dye coating before and after thermal treatment. The coating was contacted with a metal block maintained at 125° C. for 5 seconds, complete loss of visible and near IR absorption occurred as shown in the accompanying drawing.

The coating prepared as described has a strong blue color owing to the secondary absorption peak at 640 nm. In order to test the construction as a negative thermographic imaging material, the material described above was overcoated with cellulose acetate (50 micron wet thickness) using a 5% solution in acetone, in order to prevent sticking and pick-off from the original.

This coating was found to produce a pleasing white-on-blue transparent copy from printed text using a 3 M Thermofax$^{TM}$ copier set at ⅔ maximum setting.

EXAMPLE 2

Use of Dye Dl as an antihalation layer for Dry Silver Photothermographic Materials.

An infrared sensitive photothermographic layer of the 'dry silver' type was coated on the reverse side of a sample of the thermal-dye-bleach material described in Example 1.

The construction was exposed to a resolution test pattern using 815 nm infrared radiation. The sample was processed by heating for 6 seconds on a metal block maintained at 127° C. A sharp black image on a colorless background was obtained. For comparison an identical dry silver layer was coated onto clear polyester base without the thermal-dye-bleach antihalation backing layer. When tested identically the comparison material produced an unsharp image.

EXAMPLE 3

The Effect of Amine Generation on Dye Bleaching.

A range of thermal amine-generating salts was prepared combining cations selected from the list C1 to C5 and anions selected from the list A1 to A6.

| Cation | |
|---|---|
| C1 | 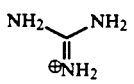 |

-continued

| | |
|---|---|
| C2 | 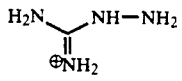 |
| C3 | 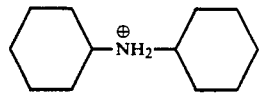 |
| C4 | 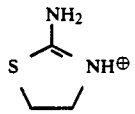 |
| C5 | 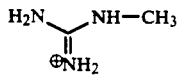 |
| Anions | |
| A1 | 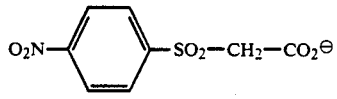 |
| A2 | 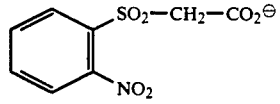 |
| A3 | 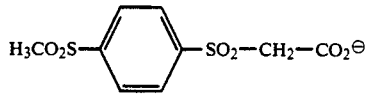 |
| A5 | 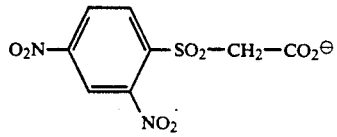 |
| A6 | 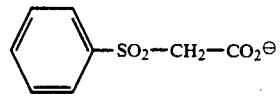 |
| A4 | $Cl_3CCO_2^{\ominus}$ |

Heat bleachable coatings were prepared as follows: A solution of dye (0.06 g) in a mixture of methanol (13 g) and N-methyl pyrrolidine (9 g) was prepared.

A solution of thermal amine-generator (0.064 g) in methanol (3.5 g) and dimethylformamide (3.5 g) was prepared.

A solution of cellulose acetate butyrate (6 g) in toluene (21 g) and butan-2-one (43 g) was prepared. The dye, amine-generator and polymer solutions were combined and mixed thoroughly and coated onto a polyester base. The coating was dried at 71° C. for 3 minutes. The visible and infrared absorption of the coating was measured. The coating was tested for thermal bleaching by contacting with a metal block maintained at 127° C. for 10 seconds and the absorption re-measured.

Table 3 reports the dyes and amine generators used together with the results upon heating. It will be seen that all combinations of dye and amine generator decolourise on heating.

TABLE 3

| DYE | AMINE GENERATOR Cation Anion | RESULT |
|---|---|---|
| D2 | C1:A1 | Decolourised on heating |
| D2 | C2:A1 | " |
| D2 | C1:A3 | " |
| D3 | C1:A1 | " |
| D4 | C1:A1 | " |
| D5 | C1:A1 | " |
| D6 | C1:A1 | " |
| D7 | C1:A1 | " |
| D8 | C1:A1 | " |
| D9 | C1:A1 | " |
| D10 | C1:A1 | " |
| D1 | C1:A1 | " |
| D1 | C2:A1 | " |
| D1 | C1:A3 | " |
| D1 | C1:A4 | " |
| D1 | C2:A4 | " |
| D9 | C2:A3 | " |
| D2 | C2:A3 | " |
| D2 | C5:A3 | " |
| D9 | C5:A3 | " |
| D2 | C5:A1 | " |

We claim:

1. A thermal-dye-bleach layer comprising a thermal nucleophile-generating agent in association with a polymethine dye having a nucleus of general formula (I):

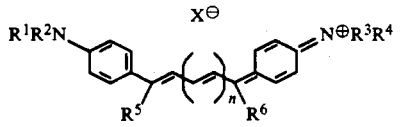

(I)

in which:

n is 0, 1, 2 or 3;

$R^1$ to $R^4$ are independently selected from consisting of hydrogen atoms, optionally substituted alkyl groups of up to 30 carbon atoms, optionally substituted alkenyl groups of up to 30 carbon atoms and optionally substituted aryl groups of up to 14 carbon atoms; or $R^1$ and $R^2$ together and/or $R^3$ and $R^4$ together may represent the necessary atoms to complete a 5 or 6-membered optionally substituted heterocyclic ring; or one or more of $R^1$ to $R^4$ may represent the necessary atoms to complete an optionally substituted 5 or 6-membered heterocyclic ring fused to the phenyl ring on which the $NR^1R^2$ or $NR^3R^4$ group is attached;

$R^5$ and $R^6$ are independently selected from the group consisting of hydrogen atoms, tertiary amino groups, optionally substituted alkyl groups of up to 10 carbon atoms, optionally substituted aryl groups of up to 10 carbon atoms, optionally substituted heterocyclic rings comprising up to 6 ring atoms, optionally substituted carbocyclic rings comprising up to 6 carbon atoms and optionally substituted fused ring systems comprising up to 14 ring atoms, and, $X^{\ominus}$ is an anion.

2. A thermal-dye-bleach layer as claimed in claim 1 in which:

$R^1$ to $R^4$ are independently selected from the group consisting of hydrogen atoms, optionally substituted alkyl groups of up to 10 carbon atoms, optionally substituted alkenyl groups of up to 10 carbon atoms and optionally substituted aryl groups of up to 10 carbon atoms;

or $R^1$ and $R^2$ together and/or $R^3$ and $R^4$ together may represent the necessary non-metallic atoms to complete an optionally substituted heterocyclic ring comprising up to 6 atoms selected from C, N, O, S and Se;

or one or more of $R^1$ to $R^4$ may represent the necessary atoms to complete an optionally substituted 5 or 6-membered heterocyclic ring fused to the phenyl ring on which the $NR^1R^2$ or $NR^3R^4$ groups is attached, and $R^5$ and $R^6$ are selected from the group consisting of hydrogen atoms, tertiary amino groups, optionally substituted alkyl groups of up to 5 carbon atoms, optionally substituted aryl groups of up to 10 carbon atoms, optionally substituted heterocyclic rings comprising up to 6 ring atoms, optionally substituted carbocyclic rings comprising up to 6 carbon atoms and optionally substituted fused ring systems comprising up to 14 ring atoms, and wherein substituents for $R^1$ to $R^6$ are selected from the group consisting of halogen atoms, nitro groups, nitrile groups, hydroxyl groups, ether groups of up to 5 carbon atoms, thioether groups of up to 5 carbon atoms, ketone groups of up to 5 carbon atoms, aldehyde groups of up to 5 carbon atoms, ester groups of up to 5 carbon atoms, amide groups of up to 5 carbon atoms, alkylthio groups of up to 5 carbon atoms, alkoxy groups of up to 5 carbon atoms, alkyl groups of up to 5 carbon atoms, alkenyl groups of up to 5 carbon atoms, aryl groups of up to 10 carbon atoms and heterocyclic ring nuclei comprising up to 10 atoms selected from C, N, O, S and Se, and combinations of these substituents.

3. A thermal-dye-bleach layer as claimed in claim 1 in which:

$R^1$ to $R^4$ are independently selected from the group consisting of hydrogen atoms, methyl, ethyl and methoxyethyl groups;

or $R^1$ and $R^2$ together and/or $R^3$ and $R^4$ together represent the necessary non-metallic ring atoms to complete morpholine or pyrrolidine nuclei;

$R^5$ and $R^6$ are independently selected from the group consisting of hydrogen atoms, 4-dimethylaminophenyl, 4-diethylaminophenyl, 4-bis (methoxyethyl)aminophenyl, 4-N-pyrrolidinophenyl, 4-N-morpholinophenyl and biphenyl groups;

or $R^5$ and/or $R^6$ may represent the necessary atoms to complete a morpholine or thiophene group, and, $X^{\ominus}$ represents trifluoromethane sulphonate or 4-toluene sulphonate.

4. A thermal-dye-bleach layer as claimed in claim 1 in which the polymethine dye has a nucleus of general formula (II):

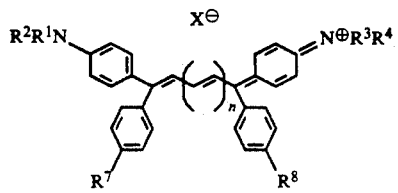

(II)

in which:

$R^1$ to $R^4$, $X^{\ominus}$ and n are as defined above, and, $R^7$ and $R^8$ are independently selected from the group consisting of $NR^1R^2$ (in which $R^1$ and $R^2$ are defined previously), hydrogen atoms, alkyl groups of up to 10 carbon atoms, alkenyl groups of up to 10 carbon atoms and aryl groups of up to 10 carbon atoms, each of which groups may possess one or more substituents as defined for $R^1$ to $R^6$.

5. A thermal-dye-bleach layer as claimed in claim 1 in which the thermal nucleophile-generating gent is a thermal amine-release agent.

6. A thermal-dye-bleach layer as claimed in claim 5 in which the thermal amine-release agent comprises an amine salt of an organic acid which liberates one or more free amine groups upon thermal decomposition.

7. A thermal-dye-bleach layer as claimed in claim 6 in which the thermal-amine release agent comprises a thermal amine-generating salt comprising a cation selected from C1 to C5 in combination with an anion selected from A1 to A6.

Cation

C1

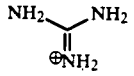

C2

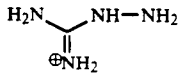

C3

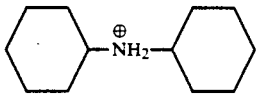

C4

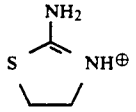

C5

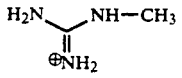

Anions

A1

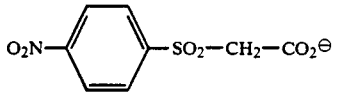

A2

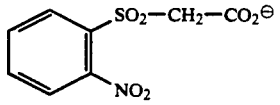

A3

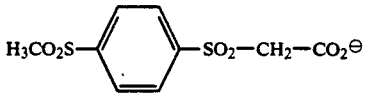

A5

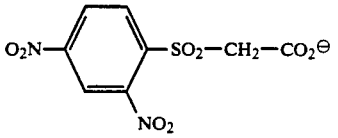

-continued

A6

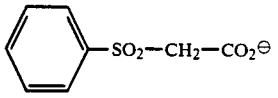

A4 $Cl_3CCO_2^{\ominus}$

8. A thermal-dye bleach layer comprising a thermal nucleophile-generating agent in association with a polymethine dye having its λ max in the infrared and having a nucleus of general formula (I):

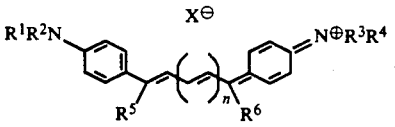

(I)

in which:

n is 0, 1, 2 or 3;

$R^1$ to $R^4$ are independently selected from the group consisting of hydrogen atoms, alkyl groups of up to 30 carbon atoms, alkenyl groups of up to 30 carbon atoms and aryl groups of up to 14 carbon atoms; or $R^1$ and $R^2$ together and/or $R^3$ and $R^4$ together may represent the necessary atoms to complete a 5- or 6-membered heterocyclic ring; or one or more of $R^1$ and $R^4$ may represent the necessary atoms to complete an 5- or 6-membered heterocyclic ring fused to the phenyl ring on which the $NR^1R^2$ or $NR^3R^4$ group is attached;

$R^5$ and $R^6$ are independently selected from the group consisting of hydrogen atoms, tertiary amino groups, alkyl groups of up to 10 carbon atoms, aryl groups of up to 10 carbon atoms heterocyclic rings comprising up to 6 ring atoms, carbocyclic rings comprising up to 6 carbon atoms and fused ring systems comprising up to 14 ring atoms, and, $X^{\ominus}$ is an anion.

9. A thermal-dye-bleach layer as claimed in claim 8 in which:

$R^1$ to $R^4$ are independently selected from the group consisting of hydrogen atoms, alkyl groups of up to 10 carbon atoms, alkenyl groups of up to 10 carbon atoms and aryl groups of up to 10 carbon atoms;

or $R^1$ and $R^2$ together and/or $R^3$ and $R^4$ together may represent the necessary non-metallic atoms to complete a heterocyclic ring comprising up to 6 atoms selected from C, N, O, S and Se;

or one or more of $R^1$ to $R^4$ may represent the necessary atoms to complete a 5- or 6-membered heterocyclic ring fused to the phenyl ring on which the $NR^1R^2$ or $NR^3R^4$ groups is attached, and $R^5$ and $R^6$ are selected from the group consisting of hydrogen atoms, tertiary amino groups, alkyl groups of up to 5 carbon atoms, aryl groups of up to 10 carbon atoms, heterocyclic rings comprising up to 6 ring atoms, carbocyclic rings comprising up to 6 carbon atoms and fused ring systems comprising up to 14 ring atoms.

10. A thermal-dye-bleach layer as claimed in claim 9 in which:

$R^1$ to $R^4$ are independently selected from the group consisting of hydrogen atoms, methyl, ethyl and methoxyethyl groups;

or $R^1$ and $R^2$ together and/or $R^3$ and $R^4$ together represent the necessary non-metallic ring atoms to complete morpholine or pyrrolidine nuclei;

$R^5$ and $R^6$ are independently selected from the group consisting of hydrogen atoms, 4-dimethylaminophenyl, 4-diethylaminophenyl, 4-bis (methoxyethyl)aminophenyl, 4-N-pyrrolidinophenyl, 4-N-morpholinophenyl and biphenyl groups;

or $R^5$ and/or $R^6$ may represent the necessary atoms to complete a morpholine or thiophene group, and $X^{\ominus}$ represents trifluoromethane sulphonate or 4-toluene sulphonate.

11. A thermal-dye-bleach layer as claimed in claim 8 in which the polymethine dye has a nucleus of general formula (II):

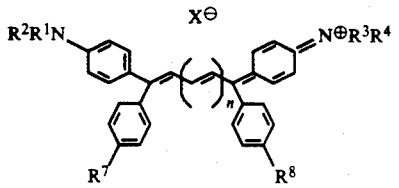

(II)

in which:

$R^1$ to $R^4$, $X^{\ominus}$ and n are as defined above, and, $R^7$ and $R^8$ are independently selected from the group consisting of $NR^1R^2$ (in which $R^1$ and $R^2$ are defined previously), hydrogen atoms, alkyl groups of up to 10 carbon atoms, alkenyl groups of up to 10 carbon atoms and aryl groups of up to 10 carbon atoms.

12. A thermal-dye-bleach layer as claimed in claim 8 in which the thermal nucleophile-generating agent is a thermal amine-release agent.

13. A thermal-dye-bleach layer as claimed in claim 12 in which the thermal amine-release agent comprises an amine salt of an organic acid which liberates one or more free amine groups upon thermal decomposition.

14. A thermal-dye-bleach layer as claimed in claim 13 in which the thermal-amine release agent comprises a thermal amine-generating salt comprising a cation selected from C1 to C5 in combination with an anion selected from A1 to A6.

Cation

C1

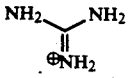

-continued

C2

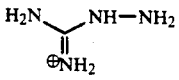

C3

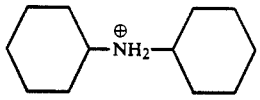

C4

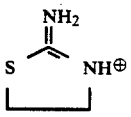

C5

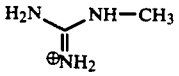

Anions

A1

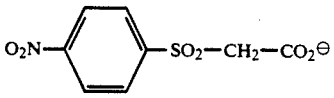

A2

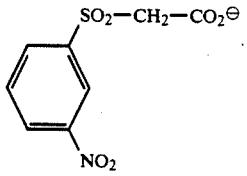

A3

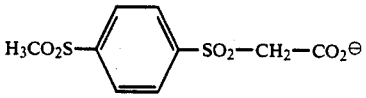

A4 $Cl_3CCO_2^{\ominus}$

A5

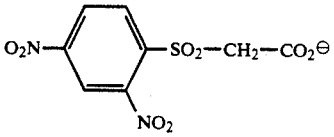

A6

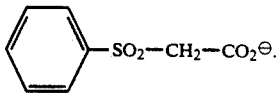

* * * * *

UNITED STATES PATENT AND TRADEMARK OFFICE

CERTIFICATE OF CORRECTION

PATENT NO. : 5,135,842

DATED : August 4, 1992

INVENTOR(S) : Jonathan P. Kitchin et al.

It is certified that error appears in the above-identified patent and that said Letters Patent is hereby corrected as shown below:

| | |
|---|---|
| Col. 4, line 23 | "nonameth lengths" should be --nonamethine chain lengths-- |
| Col. 4, line 33, | "bridgin" should be --bridging-- |
| Col. 11, line 10, | "gent" should be --agent-- |

Signed and Sealed this

Seventh Day of December, 1993

*Attest:*

*Attesting Officer*

Bruce Lehman

BRUCE LEHMAN

*Commissioner of Patents and Trademarks*